United States Patent [19]

Nakajima et al.

[11] Patent Number: 4,479,615

[45] Date of Patent: Oct. 30, 1984

[54] ROLL SHEET SUPPLYING MECHANISM FOR A RECORDING DEVICE

[75] Inventors: Hisao Nakajima; Svay Leng, both of Kanagawa, Japan

[73] Assignee: Fuji Xerox Co., Ltd., Tokyo, Japan

[21] Appl. No.: 396,948

[22] Filed: Jul. 9, 1982

[30] Foreign Application Priority Data

Jul. 24, 1981 [JP] Japan ..... 56-115324

[51] Int. Cl.[3] ..... B65H 19/02

[52] U.S. Cl. ..... 242/68.4; 242/55.2; 242/68.2; 242/129.6

[58] Field of Search ..... 242/66, 68, 68.2, 68.4, 242/55.2, 129.5, 129.51, 129.53, 129.6, 129.62, 129.7; 87/21, 55–57

[56] References Cited

U.S. PATENT DOCUMENTS

| | | | |
|---|---|---|---|
| 613,178 | 10/1898 | Unz | 242/68.4 |
| 745,500 | 12/1903 | Juelg | 242/68.4 |
| 3,034,739 | 5/1962 | Barger | 242/68.4 |
| 3,224,702 | 12/1965 | Jones et al. | 242/68.4 |
| 3,246,858 | 4/1966 | Alexeff | 242/68.4 |
| 3,601,328 | 8/1971 | McClung | 242/68.4 X |
| 3,838,829 | 10/1974 | Gotze | 242/68.4 |
| 4,353,515 | 10/1982 | Weaver et al. | 242/129.6 X |

*Primary Examiner*—John Petrakes

*Attorney, Agent, or Firm*—Sughrue, Mion, Zinn, Macpeak & Seas

[57] ABSTRACT

A roll sheet supplying mechanism for a recording device is disclosed. The mechanism allows for a roll sheet to be rolled into a recording device in a simple and convenient manner. The mechanism is comprised of a shaft having tapered end. The shaft supports the roll sheet and is positioned such that one end can be inserted within a fixed receiving portion while another end can be received within a movable receiving portion. A roll sheet is positioned on the shaft and the shaft is positioned on a support member such that the ends of the shaft are in alignment with the fixed end portion and the movable end portion. The movable end portion is retracted and may be locked into an open retracted position. The movable end portion is then released and is forced towards a shaft end by a biasing member. When the movable receiving portion contacts the tapered end of the shaft the shaft end is forced into the movable receiving end portion and consequently forces the other tapered end of the shaft into the fixed end receiving portion.

3 Claims, 4 Drawing Figures

ROLL SHEET SUPPLYING MECHANISM FOR A RECORDING DEVICE

FIELD OF THE INVENTION

This invention relates to roll sheet supplying machanisms for recording devices such as printers or copying machines, and more particularly to a roll sheet supplying mechanism in which a roll sheet unit in which a roll sheet has been loaded can be readily and detachably loaded in the sheet supplying section.

BACKGROUND OF THE INVENTION

A roll sheet, which is obtained by winding a sheet in the form of a roll, is sometimes used as a recording sheet in a recording device such as a printer or a copying machine. One example of a conventional sheet supplying machanism for mounting on a sheet supplying section a roll sheet unit in which a roll sheet has been loaded, will be described with reference to FIG. 1. A roll sheet 1, as shown in FIG. 1, is held by first and second holding members 2 and 3. The first holding member 2 is rotatably mounted on a stationary member 4 in such a manner that it will not come off the latter 4. The first holding member 2 has a shaft 2A at the inner end, which is inserted into the axial hollow of the roll sheet 1. The first holding member has a fixing flange 2B at the inner end, which serves to hold one side of the roll sheet. The second holding member 3 is rotatably and slidably mounted on a stationary member 5. The second holding member 3 has a shaft 3A at the inner end, which is inserted into the axial hollow of the roll sheet 1. The second holding member 3 further has a holding flange 3B at the inner end, which serves to hold the other side of the roll sheet 1. A spring 6 is elastically mounted between the stationary member 5 and the holding flange 3B of the second holding member 3, so that the second holding member 3 is slidable in the direction of the arrow 7 by the elasticity of the spring, i.e., the second holding member 3 is pressed against the roll sheet 1.

The roll sheet 1 is loaded in the sheet supplying section 8 having the first and second holding members 2 and 3, as follows: First, the knob 3C of the second holding member 3 is pulled in a direction opposite to the direction of the arrow 7 against the elasticait of the spring 6, so that the shafts 2A and 3A of the first and second holding members are fitted into the axial hollow of the roll sheet. Therefore, in loading a roll sheet 1 on the conventional sheet supplying mechanism, the operator must hold the roll sheet 1 with one hand while operating the knob 3C of the second holding member 3 with the other hand. Accordingly, if a roll sheet 1 is relatively heavy, it is considerably difficult for the operator to insert the shaft 3A of the second holding member into the axial hollow of the roll sheet 1 while holding it with one hand.

SUMMARY OF THE INVENTION

Accordingly, an object of this invention is to provide a roll sheet supplying mechanism in which the operator can load a roll sheet in the sheet supplying section without holding the roll sheet with his hand.

The foregoing object of the invention has been achieved by the provision of a roll sheet supplying mechanism in which, according to the invention, tapered members are formed at two ends of a roll sheet supporting shaft on which a roll sheet is fitted, and under the condition that the roll sheet is held by as set member so that the tapered members are pressed against the edges of engaging holes formed in first and second holding members, respectively, a roll sheet unit is loaded in the sheet supplying section by releasing the slidability of the second holding member.

DETAILED DESCRIPTION OF THE INVENTION

This invention will be described with reference to its preferred embodiment. It is to be understood that this invention is not limited to a particular embodiment.

Figure 1:
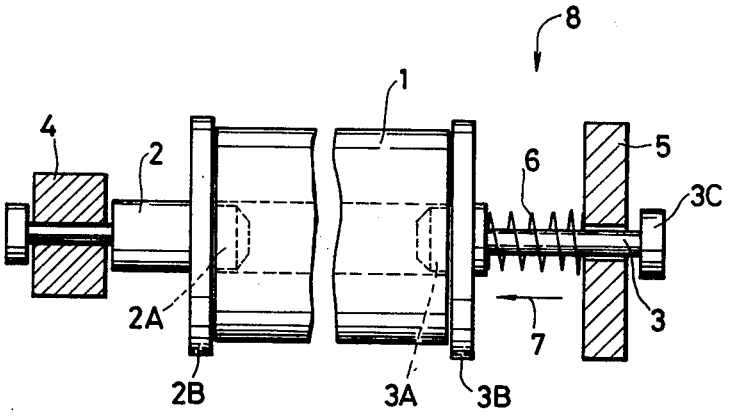
PRIOR ART FIG. 1
FIG. 1 is a front prespective view of a conventional roll sheet supplying mechanism.
Figure 2:
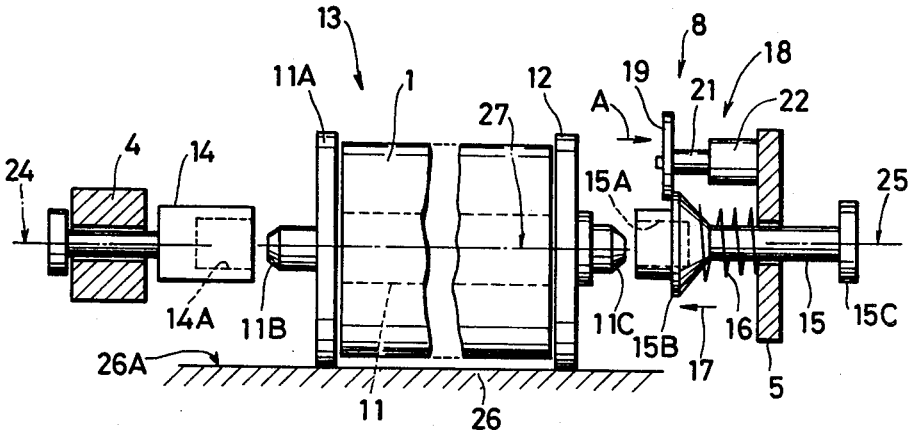
FIG. 2 is a front prespective view of the preferred embodiment of the roll sheet supplying mechanism of the invention.

As shown in FIG. 2, a fixing flange 11A is integral with one end of a roll sheet supporting shaft 11 on which a roll sheet 1 is put. That is, the fixing flange 11A is adapted to hold one side of the roll sheet 1. A holding flange 12 is detachably mounted on the other end of the roll sheet supporting shaft 11, so as to support the other side of the roll sheet 1. The roll sheet 1, the roll sheet supporting shaft 11, the fixing flange 11A integral with the shaft 11, and the holding flange 12 form a roll sheet unit 13. Relatively greatly tapered members 11B and 11C are formed at two ends of the roll sheet supporting shaft 11, so as to load the roll sheet unit 12 in the sheet supplying section 8.

An engaging hole 14A is formed in the inner end portion of a first holding member 14 which is rotatably mounted on a stationary member 4. One end portion of the roll sheet supporting shaft 11 is detachably inserted into the engaging hole 14A thus formed. A second holding member 15 has an engaging hole 15A into which the other end portion (the right end portion in FIG. 2) of the roll sheet supporting shaft 11 is detachably inserted. The second holding member 15 is slidably and rotatably mounted on an stationary member 5. A compression spring 16 is connected between the stationary member 5 and the flange 15B of the second holding member 15, so that the second holding member is pushed in the direction of the arrow 17, i.e., it is slidable to press the roll sheet unit 13.

Figure 3:
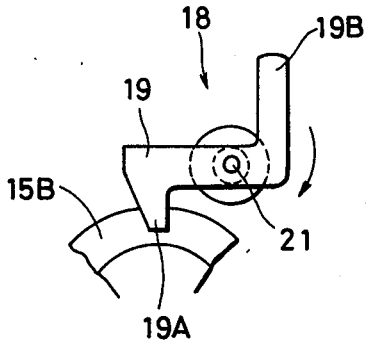
FIG. 3 is side prespective view of part of the embodiment shown in FIG. 2 as seen in the direction of the arrow A.

As shown in FIGS. 2 and 3, a locking pawl 19A of a lock lever 19, which forms a lock machanism 18, is abutted against the inner wall of the flange 15B of the second holding member 15 by the elastic force of the spring 16, to prevent the sliding of the second holding member 15 in the direction of the arrow 17. The lock lever 19 is fixedly mounted on a shaft 21. The shaft 21 is privotally coupled through friction to a post 22 which is fixedly embedded in the stationary member 5.

Figure 4:
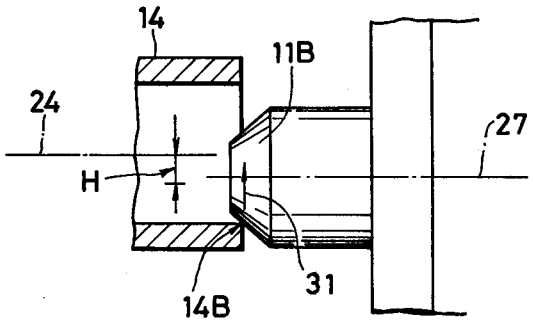
FIG. 4 is an enlarged front prespective view of a portion of the roll sheet supporting shaft of the invention.

The axis 24 of the first holding member 14 and the axis 25 of the second holding member 15 are on one line; that is, the first and second holding members 14 and 15 are coaxial. In loading the roll sheet unit 13 on the sheet supplying section 8, the flanges 11A and 12 of the unit 13 are placed on the set surface 26A of a set member 26. The set surface 26A is so positioned that the axis 27 of the roll sheet unit 13 is lower by a distance H (cf. FIG. 4) than the level of the axes 24 and 25 of the first and second holding members. In other words, when the roll sheet unit 13 is placed on the set surface 26A, the tapered member 11B of the roll sheet 11 is so positioned that it is pressed against the lowermost part of the edge 14B of the first holding member 14, while the other tapered member 11C is so positioned that it is confronted with the edge of the engaging hole 15*a* in the second holding member 15.

In order to load the roll sheet unit 13 on the sheet supplying section 8 in the roll sheet supplying mechanism thus constructed, first the unit 13 is placed on the set member 26 as shown in FIG. 2. Under this condition, the operating part 19B of the lock lever 19 is manually turned in the direction of the arrow (FIG. 3). As a result locking the flange 15B by the locking pawl 19A is released, and therefore the second holding member 15 is slid in the direction of the arrow 17 by the elastic force of the spring 16. Accordingly, the corner of the second holding member 15 presses the tapered member 11C of the roll sheet supporting shaft 11 to raise the same, and then causes the end portion (right-handed in FIG. 2) of the roll sheet supporting shaft 11 to engage with the engaging hole 15*a* of the second holding member 15. As a result of the above-described slide action of the second holding member, the roll sheet supporting shaft 11 is slid along the set surface 26A in the direction of the arrow 17. Therefore, the tapered member 11B of the supporting shaft 11 is pressed against the edge 14B of the first holding member, whereby the tapered member 11B is raised by the component of force in the direction of the arrow 31, while the end portion (left-handed in FIG. 2) of the roll sheet supporting shaft 11 is inserted into the engaging hole 14A of the first holding member.

As is apparent from the above description, upon release of the lock mechanism 18, the roll sheet unit 13 can be loaded on the sheet supplying section in one action. The unit 13 can be unloaded from the sheet supplying section readily as follows: After the knob 15C of the second holding member is slid in a direction opposite to the direction of the arrow 17, the flange 15B of the second holding member is locked with the lock mechanism 18 as shown in FIG. 2, to unload the roll sheet unit 13.

As is clear from the above description, according to the invention, by releasing, after the roll sheet unit has been placed on the set member, the lock mechanism to slide the second holding member towards the roll sheet unit, the tapered members of the roll sheet supporting shaft are raised by being abutted against the edges of the first and second holding members. Accordingly, it is unnecessary for the operator to hold the roll sheet unit in order to load it in the sheet supplying section or to unload it therefrom.

The invention has been disclosed and described in what is considered to be its most preferred embodiment. However, it is to be understood that the invention is not limited to this embodiment as modifications will become apparent to those skilled in the art upon reading this disclosure.

What is claimed is:

1. A roll support mechanism for a recording device comprising a roll, a shaft for supporting said roll with the ends of the shaft extending outwardly beyond said roll, a first shaft supporting member having a fixed end portion for supporting one end of said shaft, a second shaft supporting member having a moveable end portion for supporting the other end of said shaft, biasing means for biasing said moveable end portion toward said shaft, a locking mechanism engageable with said moveable end portion to hold said moveable end portion against the bias of said biasing means a sufficient distance from said fixed end portion to permit changing of said roll, and support means for supporting said roll intermediate said first and second supporting members only during loading of said roll with the ends of the shaft substantially aligned with said fixed end portion and said moveable end portion respectively.

2. A roll support mechanism as set forth in claim 1 wherein the opposite ends of said shaft are provided with tapered edges and said fixed end portion and said moveable end portion are each provided with sockets for the reception of said tapered shaft ends.

3. A roll support mechanism as set forth in claim 1 wherein said locking means is comprised of a pivoted lock lever adapted to be moved into and out of engagement with said moveable end portion.

* * * * *